US009795266B2

(12) United States Patent
Song et al.

(10) Patent No.: US 9,795,266 B2
(45) Date of Patent: Oct. 24, 2017

(54) SCOURER HAVING A SHAPE-SUPPORTING BODY

(76) Inventors: Chi Ho Song, Pyeongtaek-si (KR); Chi Hwa Song, Pennbel, PA (US); Chang Soo Park, Cheonan-si (KR)

( * ) Notice: Subject to any disclaimer, the term of this patent is extended or adjusted under 35 U.S.C. 154(b) by 787 days.

(21) Appl. No.: 14/111,545

(22) PCT Filed: Jun. 8, 2011

(86) PCT No.: PCT/KR2011/004203

§ 371 (c)(1),
(2), (4) Date: Oct. 12, 2013

(87) PCT Pub. No.: WO2012/141377

PCT Pub. Date: Oct. 18, 2012

(65) Prior Publication Data

US 2014/0033462 A1 Feb. 6, 2014

(30) Foreign Application Priority Data

Apr. 12, 2011 (KR) ..... 10-2011-0033688

(51) Int. Cl.
*A47L 13/16* (2006.01)
*A47L 17/08* (2006.01)

(52) U.S. Cl.
CPC ..... *A47L 13/16* (2013.01); *A47L 17/08* (2013.01)

(58) Field of Classification Search
CPC ..... A47L 13/16; A47K 17/08
USPC ..... 15/229.11, 111, 229.13, 151, 244.1; 30/169, 162
See application file for complete search history.

(56) References Cited

U.S. PATENT DOCUMENTS 1,593,922 A * 7/1926 Viragh ..... A47L 13/022 15/229.13
2,657,413 A * 11/1953 Murdock ..... A47L 13/022 15/229.11
5,187,830 A * 2/1993 Giallourakis ..... A47L 13/16 15/209.1

* cited by examiner

*Primary Examiner* — Monica Carter
*Assistant Examiner* — Stephanie Berry
(74) *Attorney, Agent, or Firm* — Antonio Ha & U.S. Patent, LLC

(57) ABSTRACT

Disclosed is a scourer (10) which can be used along with a shape-supporting body. The scourer (10) includes a mesh body (2) having a sparse and/or dense mesh and being bendable or foldable, and the shape-supporting body (13) which is formed in a flat plate shape from synthetic resin or rubber and attached to a portion of a surface of the mesh body when used. The shape-supporting body (13) has a toothed portion (13*b*) made up of a plurality of tooth-like members (13*bb*) arranged along at least one edge portion (13*a*) of the shape-supporting body (13). The scourer (10) according to the present invention is convenient for removal of dirt stuck in deep, narrow recessed portions or the inside corners of a container.

6 Claims, 11 Drawing Sheets

SCOURER HAVING A SHAPE-SUPPORTING BODY

TECHNICAL FIELD

The present invention relates to a scourer having a shape-supporting body, and more particularly to a scourer having a shape-supporting body which includes a flexible mesh body and a shape-supporting body enabling the mesh body to maintain a shape and facilitating removal of dirt or grease, the scourer enabling effective removal of dirt or grease attached to inside surfaces of deep and narrow recessed portions as well as the inside corners of various containers.

BACKGROUND ART

A scourer is generally used to wash various kitchen utensils and containers of various purposes. There are various types of scourers, such as a mesh type formed of a mesh body and a sponge type containing a piece of sponge therein.

FIG. 1 is a schematic view illustrating a scourer of mesh type according to a conventional art, and FIG. 2 is a view illustrating a state in which the mesh-type scourer is used to clean a recessed portion of a container.

As illustrated in FIG. 1, a mesh-type scourer 1 according to a conventional art has a mesh body 2 like a net which has a sparse and/or dense mesh and can be easily bent or folded. When using the scourer, a user first soaks the mesh-type scourer 1 with cleaning liquid and scrubs dirt or grease off the surfaces of various forms of containers using the wet mesh-type scourer 1.

However, it is difficult to clean a recessed portion of a container 3 using the mesh-type scourer 1 as illustrated in FIG. 2 because the mesh-type scourer 1 of the conventional art is too soft and flexible to be inserted into the recessed portion 4 of the container 3 and to remove dirt from the recessed portion. In order to solve the problem attributable to the softness and flexibility, it is advisable to fold the mesh-type scourer 1 multiple times when using the mesh-type scourer so that the mesh-type scourer 1 becomes stiffer. However, in this case, the stiffness of the mesh-type scourer 1 is not enough and it becomes more difficult to make the scourer to enter into the recessed portion 4 due to the increased thickness of the mesh-type scourer 1.

FIG. 3 is a schematic perspective view illustrating a sponge-type scourer according to another conventional art, and FIG. 4 is a view illustrating a state in which the sponge-type scourer is used to clean a recessed portion of a container.

As illustrated in FIG. 3, a sponge-type scourer 5 according to a conventional art includes a piece of sponge 6 and a mesh body which has a sparse and/or dense mesh, is flexible so as to be bent or folded, and encloses the sponge 6. The sponge-type scourer 5 further includes side edge portions 7 which are flat and formed by subjecting respective open end portions of the mesh body 2 to heat plate bonding. When using the sponge-type scourer 5, a user first soaks the sponge-type scourer 5 with cleaning liquid and scrubs off dirt or great attached to the surfaces of various forms of containers using the wet sponge-type scourer. In this case, the user can clean a recessed portion 4 of a container 3 by inserting the flat side edge portions 7 into the recessed portion 4, as shown in FIG. 4.

In this case, although the side edge portions 7 of the sponge-type scourer 5 can be inserted into the recessed portion 4 of the container 3 as illustrated in FIG. 4, it is difficult to remove the dirt from the recessed portion 4 because the side edge portions 7 have insufficient stiffness or rigidity. Further, since the entire side edge portions 7 of the sponge-type scourer 5 are flat, the dirt in the recessed portion 4 of the container 3 is difficult to be removed and is sometimes pressed.

DISCLOSURE

Technical Problem

Accordingly, the present invention has been made keeping in mind the above problems occurring in the prior art, and an object of the present invention is to provide a scourer having a shape-supporting body which is useful in removing dirt stuck in deep and narrow recessed portions or inside corners of containers as well as in cleaning surfaces of containers of various purposes.

Another object of the present invention is to provide a scourer having a shape-supporting body which facilitates removal of dirt firmly sticking to the inside surfaces of a deep and narrow recessed portion of a container or the inside corners of a container and is convenient to remove dirt because the scourer can be easily deformed in a manner of conforming to the shape of the recessed portion.

A further object of the present invention is to provide a scourer having a shape-supporting body which has a compact structure, is easy to manufacture or install, and is convenient to handle and use.

Technical Solution

In order to accomplish the objects of the present invention, according to a first embodiment, a scourer includes a mesh body which has a sparse and/or dense mesh and is easily bendable or foldable, and a shape-supporting body which is formed in a flat plate shape from synthetic resin or rubber, is attached to at least a portion of one surface of the mesh body, and has a toothed portion at, at least one edge thereof.

The first embodiment may have the following specific structures.

The shape-supporting body may have a locking portion which detachably fixes a portion of the mesh body to the shape-supporting body when the shape-supporting body is covered by the mesh body and used.

The shape-supporting body may have a material-saving structure, in a middle portion, which is thinner or more slender than the other portions so that the scourer can be easily deformed to conform to a shape of a recessed portion of a container to be cleaned.

Tooth-like members of the toothed portion may have a triangular shape, a rectangular shape, an arc shape, or an arbitrary polygonal shape.

The mesh body and the shape-supporting body may be joined to each other through sewing or through heat plate bonding According to a second embodiment and a third embodiment, a scourer includes a piece of sponge, a mesh body which has a sparse or dense mesh, is easily bendable or foldable, and encloses the sponge, and a shape-supporting body which is formed in a flat plate shape from synthetic resin or rubber, has a toothed portion which has a plurality of tooth-like members, and is attached to at least one flat edge portion of the mesh body which protrudes sideways.

The second and third embodiments have the following specific structures.

The shape-supporting body may include a first plate portion in which two through holes are formed at a predetermined distance, a second flat portion in which two connecting protrusions are formed at a predetermined distance in positions corresponding to the through holes of the first flat portion, and a middle portion which is unified with the first flat portion and second flat portion and functions as a hinge so that either one of the first and second flat portions is folded to overlap the other.

The middle portion may function as a hinge and have two toothed slots extending along a longitudinal direction and arranged in the longitudinal direction. Each toothed slot has a toothed portion having a plurality of tooth-like members arranged along longitudinal edges of the slot. The middle portion may further include two connecting portions at respective ends of the toothed slot in the longitudinal direction in order to connect two parts divided by the slots.

Each of the connecting protrusions may have a conical upper end portion which is inserted into the corresponding through hole of the first flat portion and a stem portion which is unified with the second flat portion at the bottom thereof and with the conical upper end portion at the top thereof, and has an outer diameter smaller than a diameter of the bottom of the conical upper end portion.

The shape-supporting body may be fixed to the mesh body through an insert molding process, in a manner of partially covering the flat edge portion of the mesh body.

The shape-supporting body has a middle portion which is shaped to save material (or prevent waste of material) when the shape-inserting body is fixed to the mesh body through the insert molding process.

Advantageous Effects

According to the present invention, in a scourer, a toothed portion with a plurality of tooth-like members is provided to a simple mesh body or a mesh body containing a piece of sponge therein. Therefore, the scourer is effective in removing dirt, loosely or firmly sticking to deep and narrow recessed portions or the inside corners of kitchen containers or containers of various purposes as well as to the surfaces of the containers.

The shape-supporting body having a plurality of toothed portions, each having a plurality of tooth-like members, is fixed to the simple mesh body, or the mesh-body containing sponge therein. For example, the shape-supporting body may be fixed through sewing, an insert molding process, or the like so that a user may have a variety of choices.

The shape-supporting body having a plurality of toothed portions and a material-saving structure is attached to a simple mesh body, or a mesh body containing sponge therein, so that the scourer can be freely deformed to conform to the shape of a deep, narrow recessed portion of a container, thus easily removing dirt from the recessed portion.

The shape-supporting body having a plurality of toothed portions, each provided with a plurality of tooth-like members, has at least one locking portion which detachably fixes a portion of the mesh body to the shape-supporting body so that the shape-supporting body will not be separated from the mesh body when the shape-supporting body is covered by the mesh body and used. This improves convenience in scrubbing.

MODE FOR INVENTION

Figure 1:
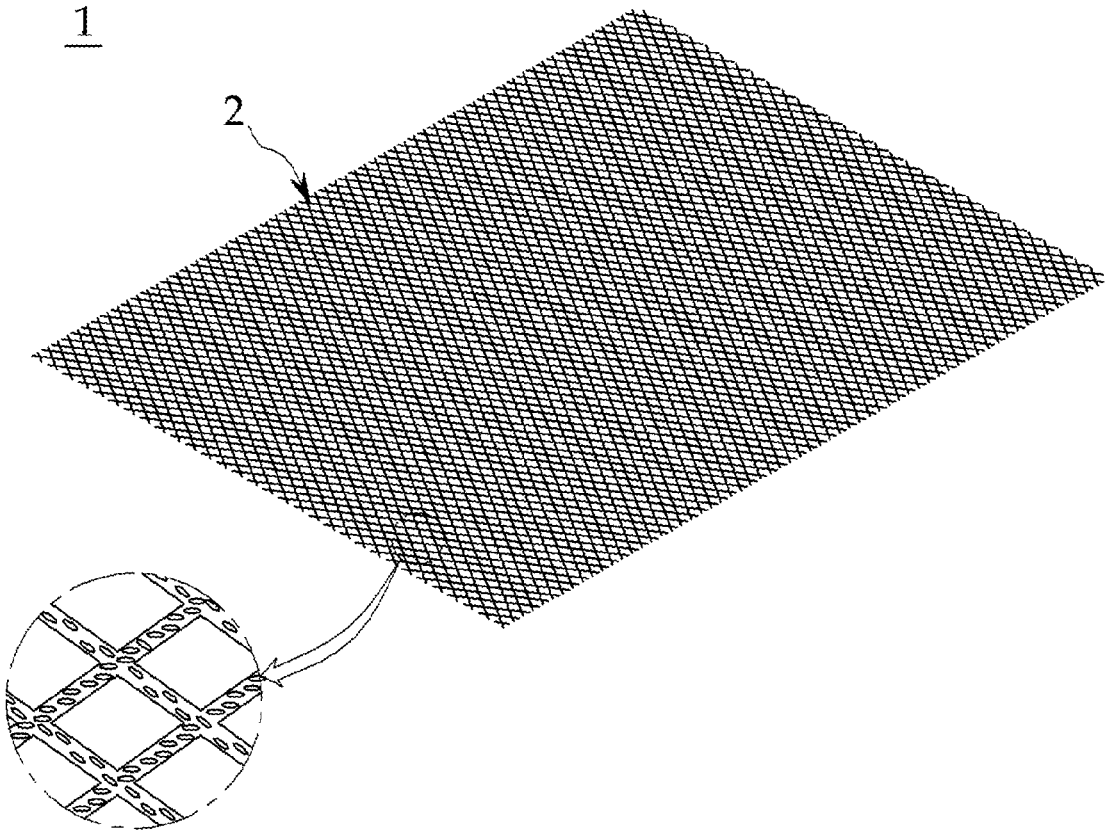
FIG. 1 is a schematic perspective view illustrating a mesh-type scourer according to one example of a conventional art.
Figure 2:
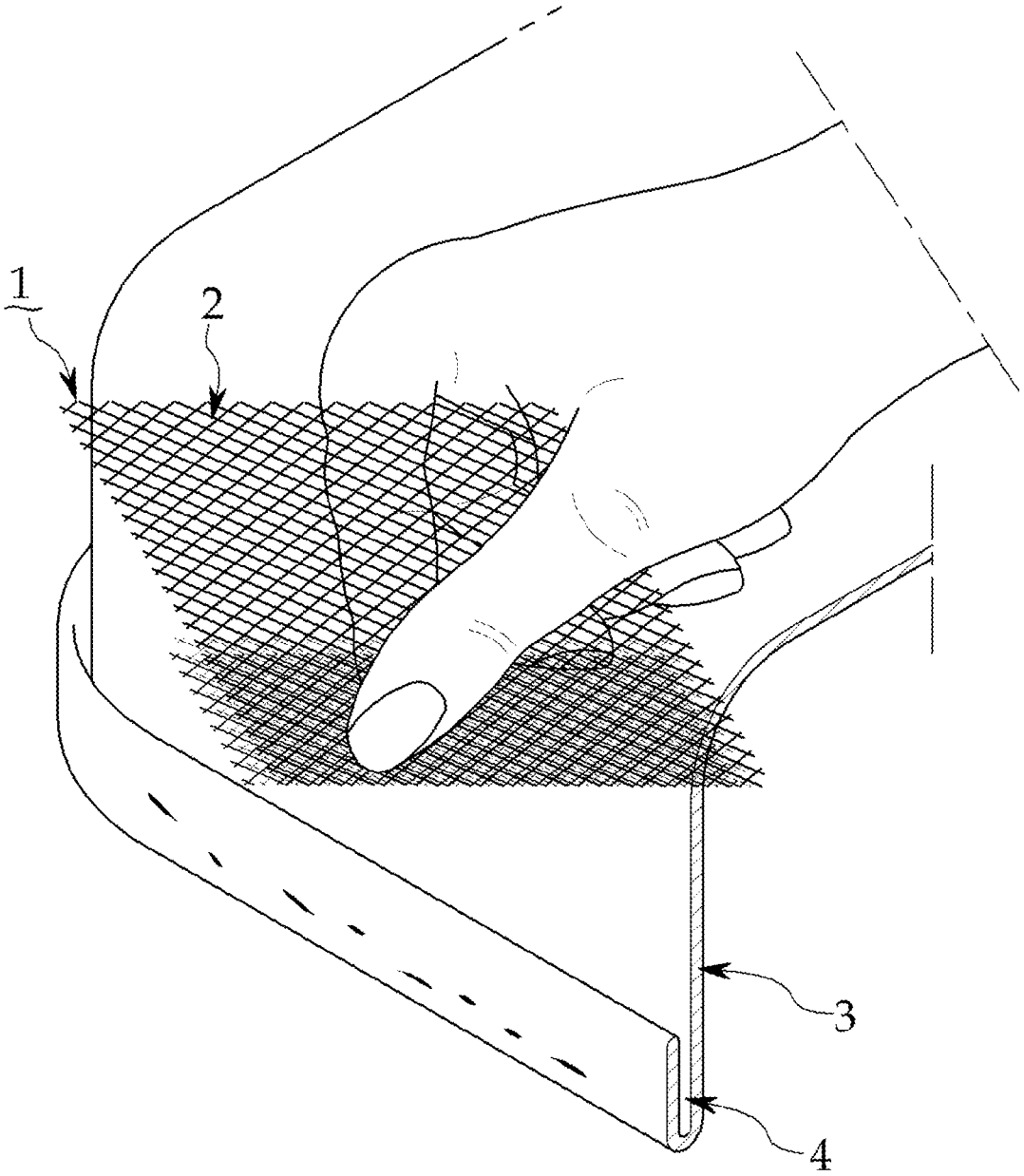
FIG. 2 is a view illustrating a state in which the mesh-type scourer is used to clean a recessed portion of a container.
Figure 3:
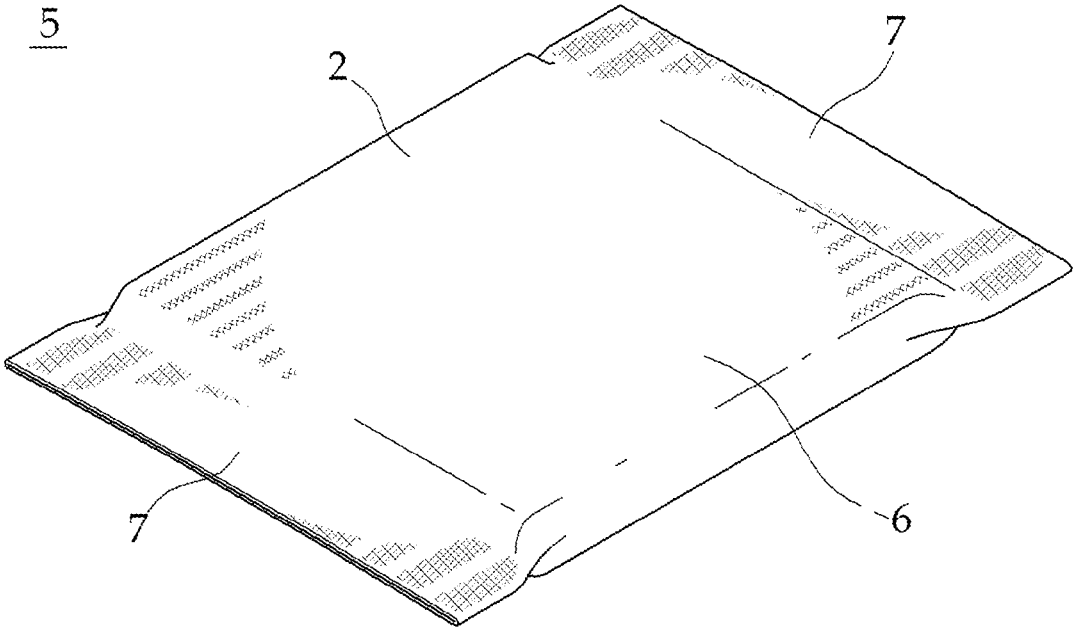
FIG. 3 is a perspective view illustrating a sponge-type scourer according to another example of conventional art.
Figure 4:
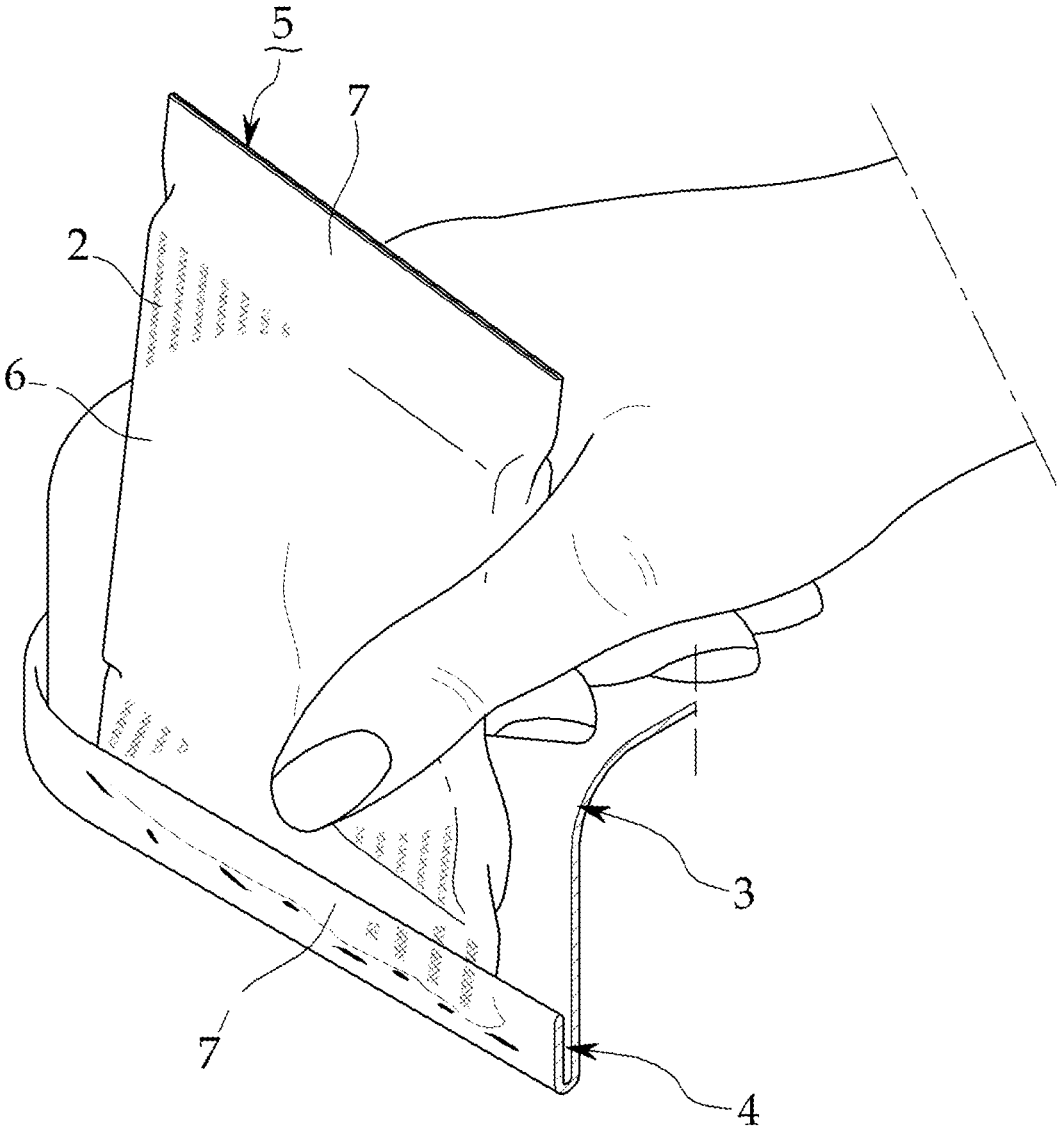
FIG. 4 is a view illustrating a state in which the sponge-type scourer is used to clean a recessed portion of a container.

Reference should now be made to the drawings, in which the same reference numerals are used throughout the different drawings to designate the same or similar components.

Hereinbelow, scourers having a shape-supporting body according to embodiments of the present invention will be described with reference to FIGS. 5 to 11.

Figure 5:
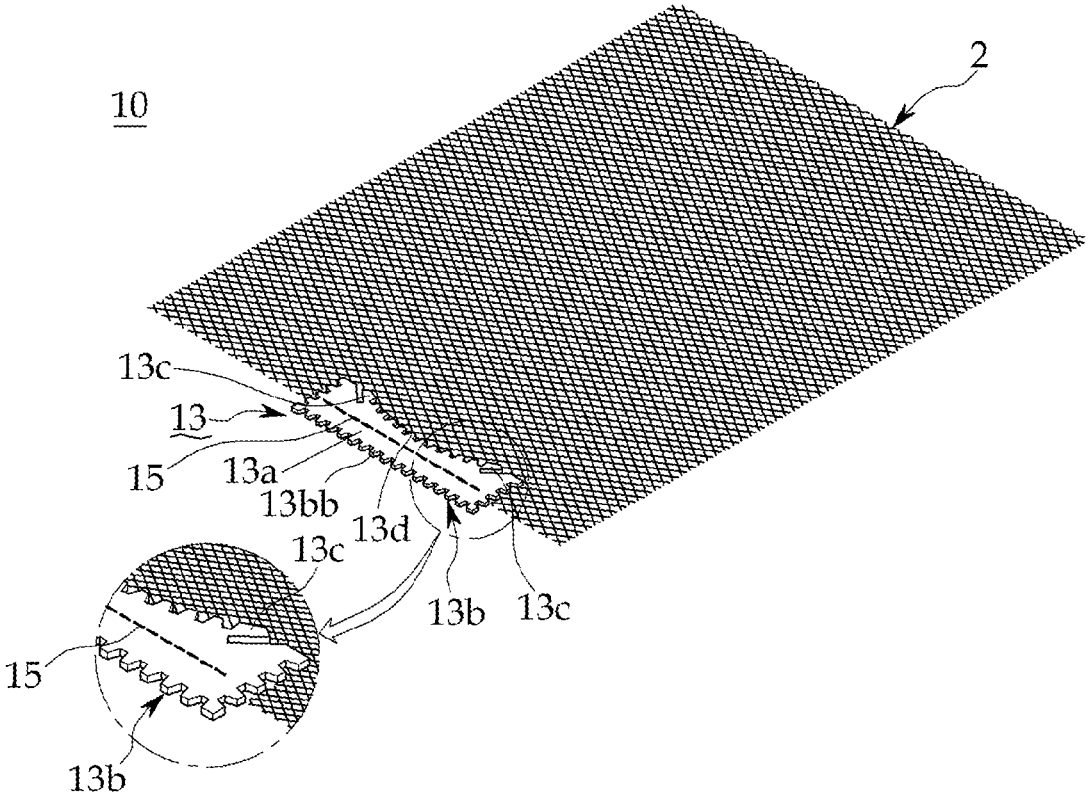
FIG. 5 is a schematic perspective view illustrating a scourer having a shape-supporting body according to a first embodiment.
Figure 6:
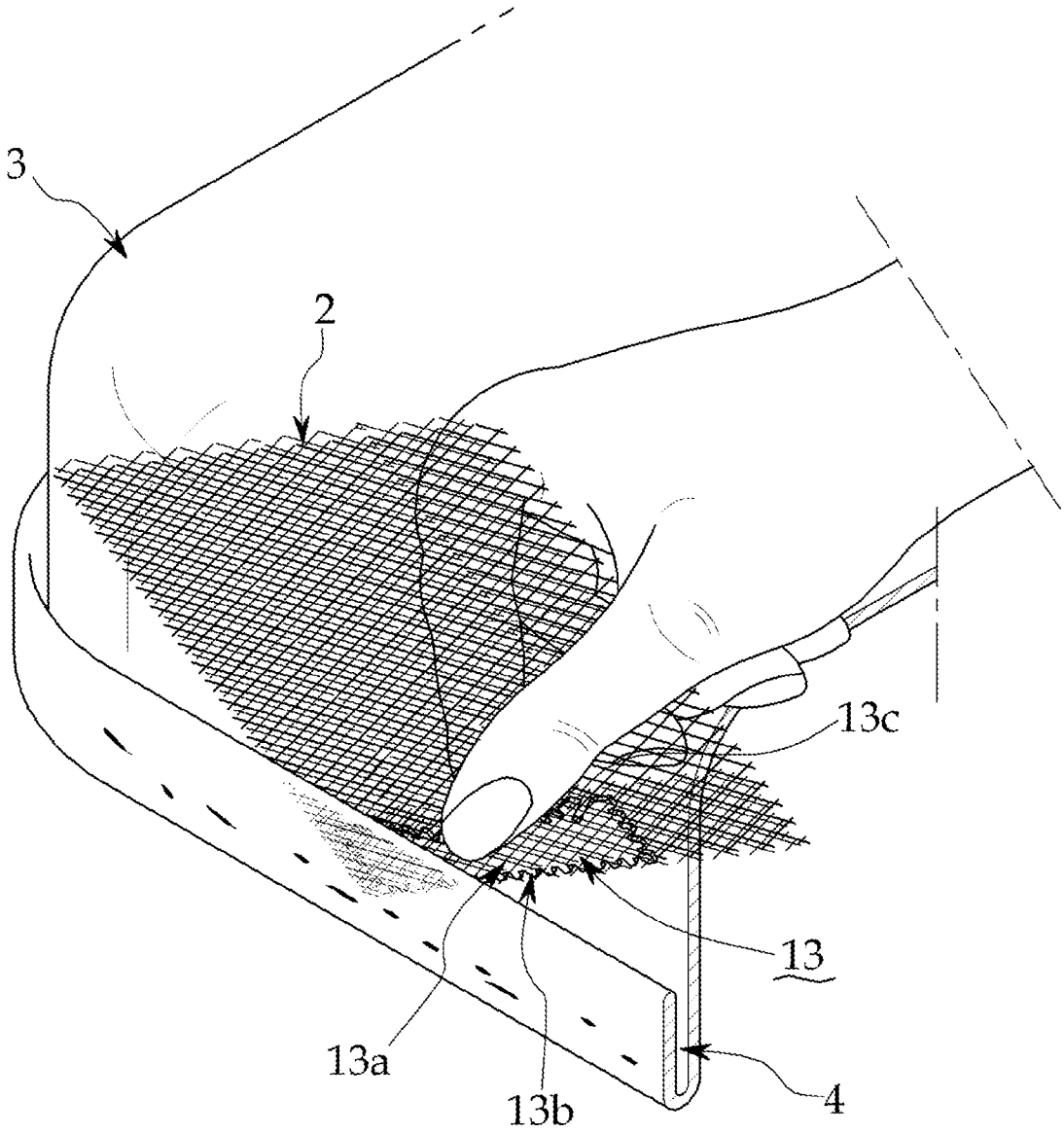
FIG. 6 is a view illustrating a state in which the scourer having a shape-supporting body according to the first embodiment is used to clean a recessed portion of a container.

As illustrated in FIGS. 5 and 6, a scourer 10 having a shape-supporting body according to a first embodiment includes a mesh body 2 which has a sparse and/or dense mesh and is bendable or foldable, and a shape-supporting body 13 which is formed in a flat plate shape from synthetic resin or rubber and has a toothed portion 13*b* attached to a portion of one surface of the mesh body 2 and provided with a plurality of tooth-like members 13*bb* arranged along an edge portion 13*a*. The size of the mesh of the mesh body 2 is arbitrary as long as it enables absorption of water or washing-up liquid to the mesh body 2.

AS illustrated in FIG. 5, compared with a conventional mesh-type scourer, the scourer 10 having the shape-supporting body according to the first embodiment of the present invention is advantageous in that the shape-supporting body 13 having a flat plate shape and being made from synthetic resin or rubber is attached to a portion of one surface of the mesh body 2, the toothed portion 13*b* provided with the plurality of tooth-like members 13*b* is formed at, at least one edge portion 13*a* of the shape-supporting body 13. As illustrated in FIG. 6, the scourer 10 according to the first embodiment can easily remove dirt loosely or firmly sticking to deep, narrow recessed portions 4 or the inside corners of a container 3 as well as clean the surfaces of containers of various purposes.

The scourer having the shape-supporting body according to the first embodiment has the following specific structure.

As illustrated in FIGS. 5 and 6, the shape-supporting body 13 may further include at least one locking portion 13*c* which detachably fixes a portion of the mesh body 2 to the shape-supporting body 13 when the shape-supporting body 13 is covered by the mesh body 2 and used.

The locking portion 13*c* of the shape-supporting body 13 stably fixes the mesh body 2 covering the shape-supporting body 13. This prevents the mesh body 2, which encloses the shape-supporting body 13, from being inadvertently separated from the shape-supporting body 13 when the shape-supporting body 13 is used to clean a deep, narrow recessed portion of a container 3.

Further, as illustrated in FIGS. 5 and 6, a middle portion of the shape-supporting body 13 is a material-saving structure 13*d* which is thinner or more slender than the other portions. The material-saving structure 13*d* of the shape-supporting body 13 enables the scourer to be easily deformed to conform to the shape of the recessed portion 4 of the container 3.

In addition, as illustrated in FIGS. 5 and 6, preferably the tooth-like member 13*bb* of the toothed portion 13*b* has a triangular shape, a rectangular shape, an arc shape, or an arbitrary polygonal shape. The tooth-like structure of the toothed portion 13*b* enables the mesh body 2 to be fixed to the tooth-like members 13*bb*, thus improving cleaning performance. That is, it causes the scourer to dig out the dirt stuck in the deep, narrow recessed portion 4 of the container 3 and collects the removed dirt in valleys of the structure of the tooth-like members 13*bb*.

In addition, as illustrated in FIGS. 5 and 6, the mesh body 2 and the shape-supporting body 13 are fixed to each other through sewing using a thread 15 or through heat plate bonding. The fixing through sewing or heat plate bonding is achieved using a sewing machine or a heat stacking machine which is easily available and thus manufacturing cost is reduced. The fixing structure obtained through sewing or heat plate bonding is suitable when the mesh body 2 and the shape-supporting body 13 are used in a combined state for its entire life span.

A scourer having a shape-supporting body according to a second embodiment and a third embodiment are described with reference to FIGS. 7 to 11.

A scourer 20 having a shape-supporting body according to the second or third embodiment includes a piece of sponge 6, a mesh body 2, and a shape supporting body 21 (or 21A) as illustrated in FIGS. 7 to 11.

The sponge 6 may be replaced by any material as long as the material can absorb cleaning liquid and/or water and is elastic. The mesh body 2 encloses the sponge 6, has a sparse and/or dense mesh, and is bendable or foldable. The size of the mesh of the mesh body 2 is arbitrary as long as it enables absorption of cleaning liquid and/or liquid.

The shape-supporting bodies 21 and 21A has a flat plate shape and are made from synthetic resin or rubber. The shape-supporting bodies 21 and 21A have toothed portions 21*b* which are attached to the flat side edge portions 7 of the mesh body which protrude from side edges of the mesh body 2. The toothed portion 21*b* is attached in a manner of partially covering the flat side edge portion 7. The toothed portion 21*b* includes a plurality of tooth-like members 21*bb* arranged along at least one side edge portion 21*a*.

Figure 7:
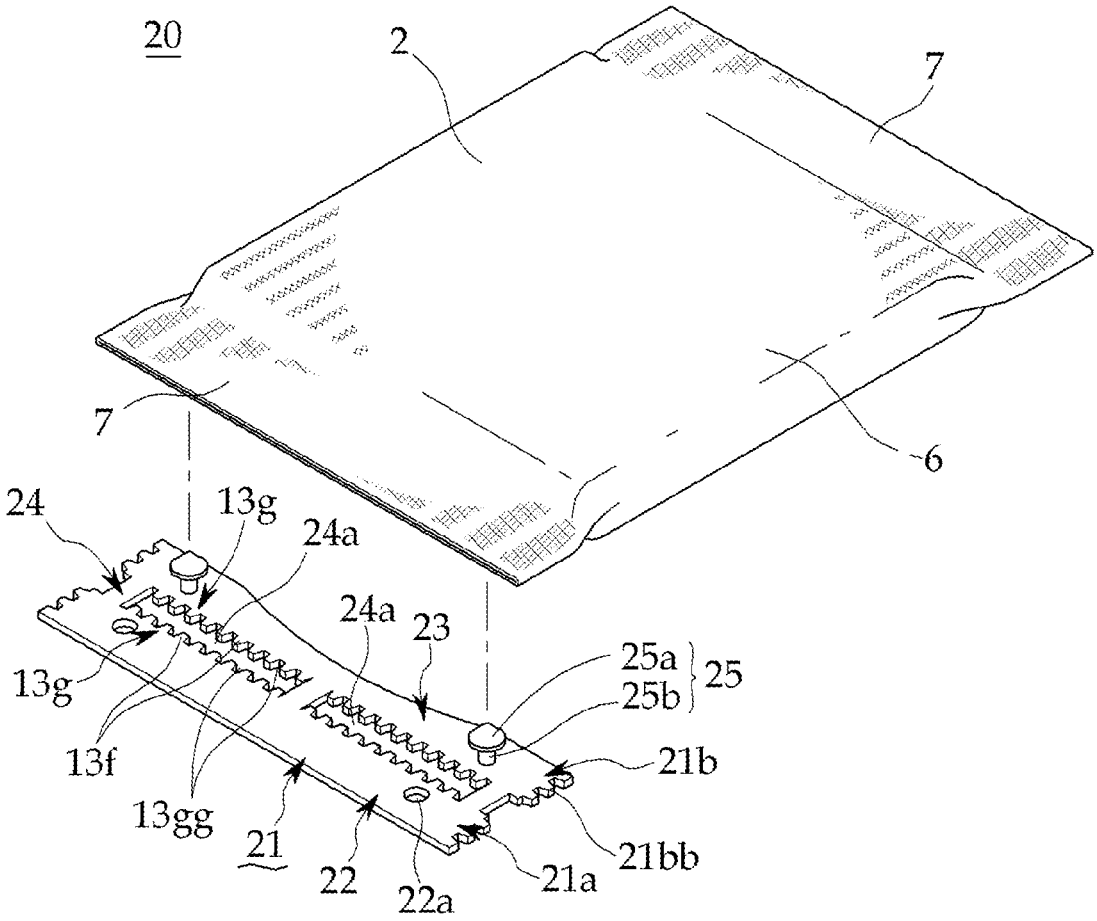
FIG. 7 is an exploded schematic perspective view illustrating a scourer having a shape-supporting body according to a second embodiment.
Figure 8:
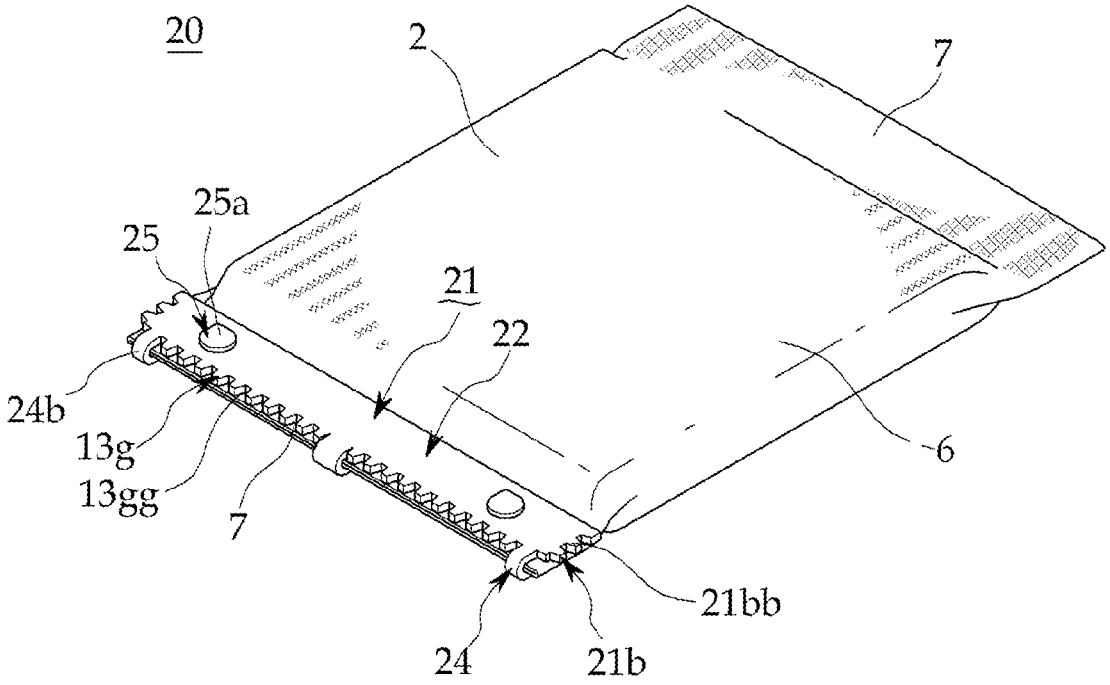
FIG. 8 is a schematic view illustrating the scourer having a shape-supporting body according to the second embodiment.
Figure 9:
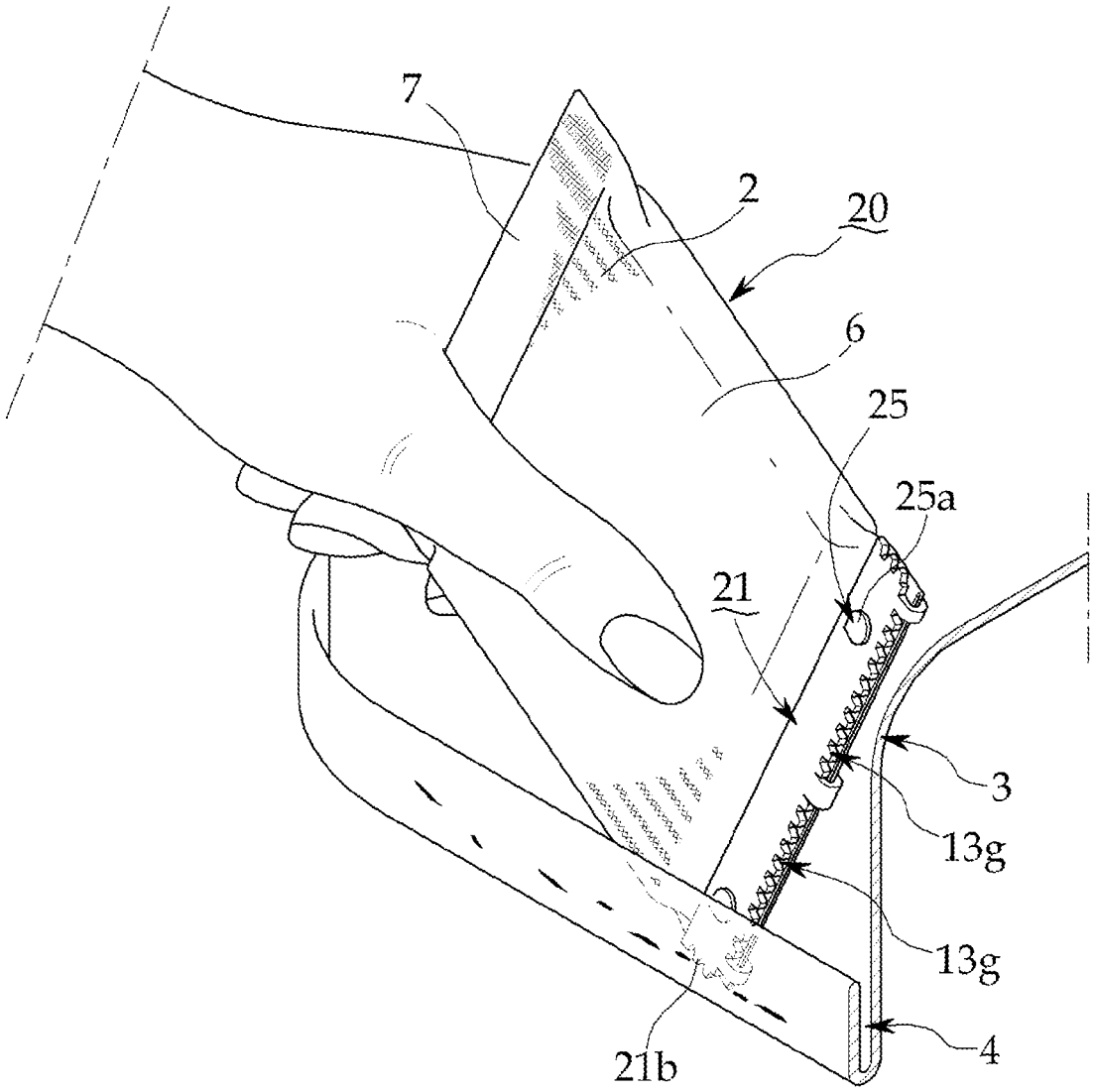
FIG. 9 is a view illustrating a state in which the scourer having a shape-supporting body according to the second embodiment is used to clean a recessed portion of a container.
Figure 10:
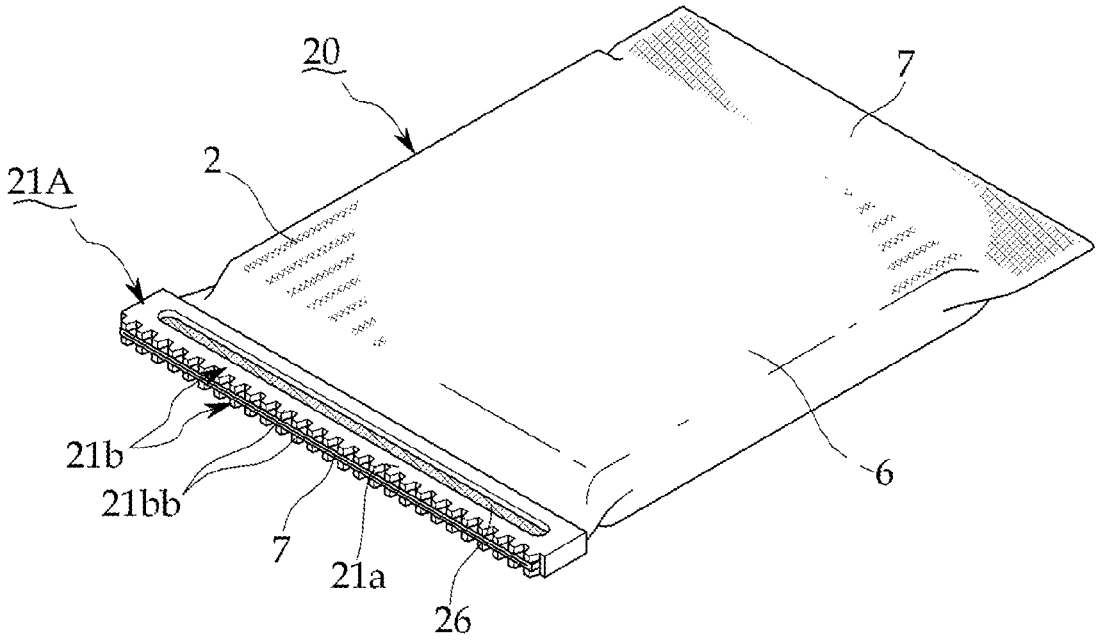
FIG. 10 is a schematic view illustrating a scourer having a shape-supporting body according to a third embodiment.
Figure 11:
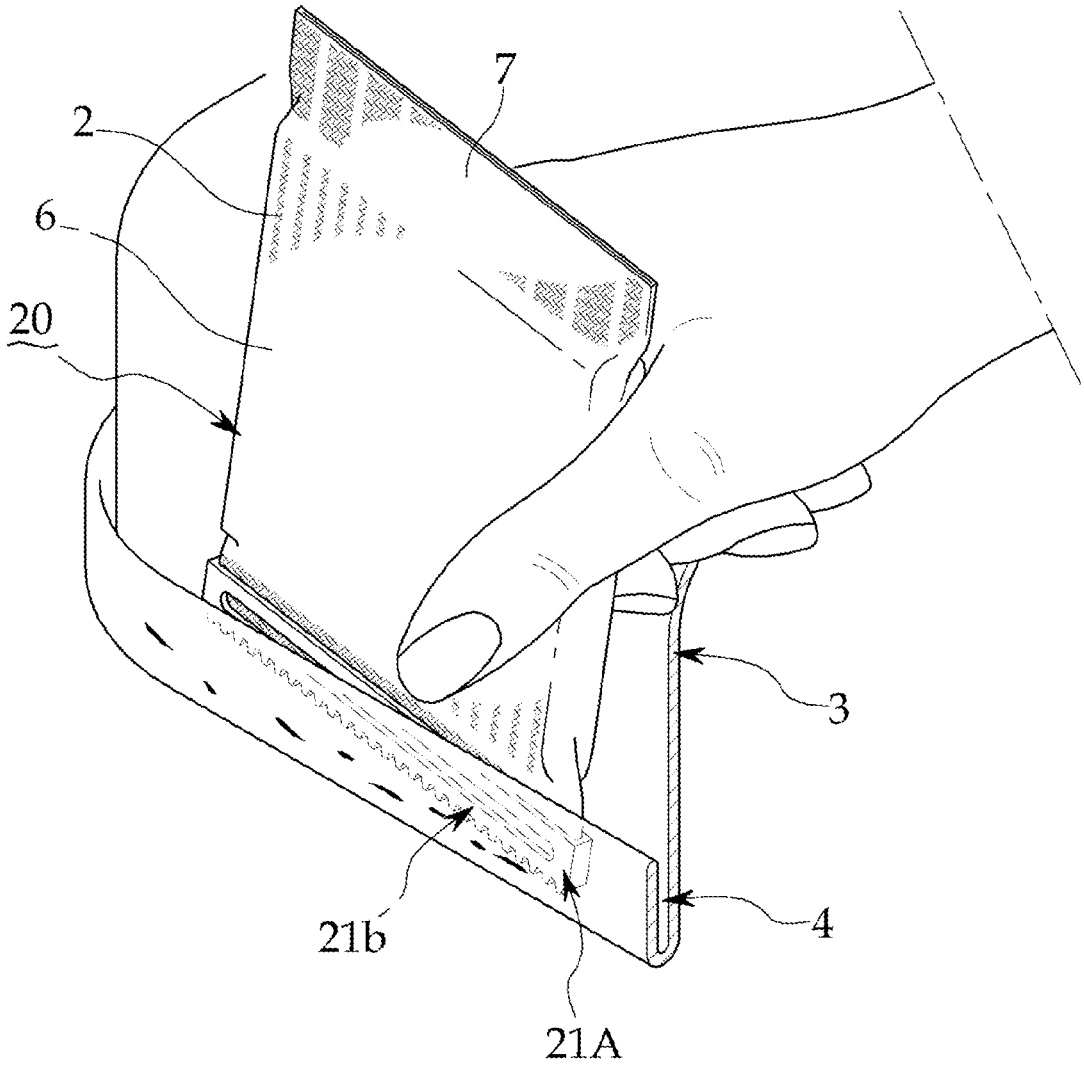
FIG. 11 is a view illustrating a state in which the scourer having a shape-supporting body according to the third embodiment is used to clean a recessed portion of a container.

As illustrated in FIGS. 7, 8, and 10, the scourer 20 having the shape-supporting body according to the second or third embodiment is different from a conventional sponge-type scourer in that the shape-supporting body 21 or 21A which is made from synthetic resin or rubber hand has a flat plate shape is attached to one of the respective side edge portions 7 of the mesh body 2 and that the toothed portion 21*b* including the plurality of tooth-like members 21*bb* is provided to at least one edge portion 21*a* of the shape-supporting body 21 or 21A. Accordingly, as illustrated in FIGS. 9 and 11, the scourer 20 according to the second or third embodiment is convenient for removal of dirt which is loosely or firmly sticking to the deep, narrow recessed portion 4 or the inside corners of the container 3 as well as for cleaning of the surfaces of kitchen containers of various purposes.

The scourer having the shape-supporting body according to the second or third embodiment specifically features in the following structure.

As illustrated in FIGS. 7 and 8, the shape-supporting body 21 includes a first flat portion 22, a second flat portion 23, and a middle portion 24. The first flat portion 22 has at least two through holes 22*a* formed at a predetermined distance. The second flat portion 23 has at least two connecting protrusions 25 formed at a predetermined distance in positions corresponding to the through holes 22*a* of the first flat portion. The middle portion 24 is connected between the first flat portion 22 and the second flat portion 23 and functions as a hinge so that either the first flat portion 22 or the second flat portion 23 can be folded to overlap the other.

The shape-supporting structure including the first flat portion 22, the second flat portion 23, and the middle portion 24 can be detachably attached to the edge portion 7 of the scourer 20. Accordingly, a user can attach and detach the shape-supporting body 21 to and from the edge portion 7 of the scourer 20 as necessary.

When a user attaches the shape-supporting body 21 to the edge portion 7 of the scourer 20, the user first places the shape-supporting body 21 on the edge portion 7 of the sourer 20, then folds the shape-supporting body 21 at the middle portion 21 so that the first flat portion 22 overlaps the second flat portion 23, and inserts the two connecting protrusions 25 of the second flat portion 23 into the two through holes 22*a* of the first flat portion 22. At this time, the two connection protrusions 25 pass through the mesh of the mesh body 2 of the scourer 20. Conversely, when the user wants to remove the shape-supporting body 21 from the edge portion 7 of the scourer 20, the operations for attachment are performed in reverse order.

In the shape-supporting body having the structure described above, as illustrated in FIG. 7, the middle portion 24 functions as a hinge and may have two toothed slots 24*a* which are arranged in the longitudinal direction thereof and are also formed to extend along the longitudinal direction thereof. Respective side end portions of the middle portion 24 of the shape-supporting body in the longitudinal direction serve as connecting portions 24*b* for connecting two parts of the shape-supporting body on both sides of the toothed slots 24*a* to each other. Each of the toothed slots 24*a* has a toothed portion 13*g* including a plurality of tooth-like members 13*gg* arranged along longitudinal edges 13*f* of the toothed slot 24*a*. The middle portion having this structure improves cleaning performance as well as functions as a hinge. In addition, each of the connecting protrusions 25 has a conical upper end portion 25*a* which is to be inserted into the through hole 22*a* of the first flat portion 22 and a stem portion 25*b* which is unified to the first flat portion 23 at the bottom and to the conical upper end portion 25*a* at the top, and has an outer diameter smaller than that of the bottom of the conical upper end portion 25*a*. This structure of the connecting protrusion facilitates attachment and detachment between the first flat portion 22 and the second flat portion 23.

FIG. 10 is a schematic perspective view illustrating the shape-supporting body according to the third embodiment, and FIG. 11 is a state in which a scourer having the shape-supporting body according to the third embodiment is used to clean a recessed portion of a container.

As illustrated in FIGS. 10 and 11, the shape-supporting body 21A may be fixed to an edge portion 7 of the scourer 20 through an insert molding process so that the shape-supporting body 21A partially covers the flat edge portion 7 of the scourer 20. The fixing structure of the shape-supporting body 21A obtained through the insert molding process secures stable fixture between the edge portion 7 of the scourer 20 and the shape-supporting body 21A. Accordingly, even after the scourer 20 is used many times, the shape-supporting body 21A is not likely to be separated from the flat edge portion 7 of the scourer 20. In addition, as illustrated in FIGS. 10 and 11, the shape-supporting body 21A may be formed by inserting the flat edge portion 7 of the scourer 20 in a mold (not illustrated) of the shape-supporting body 21A, pouring a molten resin into the mold, and curing the resin through a cooling process.

In addition, as illustrated in FIG. 10, the shape-supporting body 21A may have a material-saving structure 26, in a middle portion thereof, by which a material used to fix the shape-supporting body 21 to the mesh body 2 through an insert molding process is reduced. That is, a middle portion of the shape-supporting body 21A is thinner than the other portions. The material-saving structure may be a hole, a recess, or a wave pattern, for example.

The present invention is not limited by the embodiments described above and the accompanying drawings, and those skilled in the art will appreciate that various modifications, additions and substitutions are possible, without departing from the scope and spirit of the invention as disclosed in the accompanying claims.

The invention claimed is:

1. A scourer comprising:

a mesh body having a mesh and being bendable or foldable; and a shape-supporting body which is formed in a flat plate shape from synthetic resin or rubber, is attached to a portion of the mesh body, and has a toothed portion, provided with a plurality of tooth-like members arranged along at least one edge of the shape-supporting body, wherein the shape-supporting body includes:

a first flat portion having at least two through-holes formed at a predetermined distance;

a second flat portion having at least two connecting protrusions formed at a predetermined distance in positions corresponding to the through holes of the first flat portion; and a middle portion which is connected between the first flat portion and the second flat portion and functions as a hinge so that either the first flat portion or the second flat portion is folded to overlap the other, and wherein the middle portion functions as a hinge and has a toothed slot having a toothed portion provided with a plurality of tooth-like members arranged along two longitudinal edges of the toothed slot, and further has at least two connecting portions formed at respective ends of the toothed slot in a longitudinal direction.

2. The scourer according to claim 1, wherein the mesh body encloses the sponge, and one at least of sides of the mesh body consists of one edge portion of respective edge portions protruding from sides of the mesh body.

3. The scourer according to claim 1, wherein the middle portion of the shape-supporting body is a material-saving structure which is relatively slender so that the shape-supporting body is easily deformed to conform to a shape of a recessed portion of a container to be cleaned.

4. The scourer according to claim 1, wherein the tooth-like member of the toothed portion has a triangular shape, a rectangular shape, an arc shape, or an arbitrary polygonal shape.

5. The scourer according to claim 1, wherein the shape-supporting body is attached to one edge portion of respective edge portions protruding from sides of the mesh body in a manner of covering the edge portion.

6. The scourer according to claim 1, wherein the connecting protrusion includes a conical upper end portion to be inserted into the through-hole of the first flat portion, and a stem portion which is unified with the second flat portion at a bottom thereof and with the conical upper end portion at a top thereof and has an outer diameter smaller than that of a bottom of the conical upper end portion.

* * * * *